US006196025B1

(12) United States Patent
Moshkovitz

(10) Patent No.: US 6,196,025 B1
(45) Date of Patent: Mar. 6, 2001

(54) PERSONALIZED JEWELRY

(76) Inventor: Isac M. Moshkovitz, Postfach 22, A-1022 Vienna (AT)

( * ) Notice: Subject to any disclaimer, the term of this patent is extended or adjusted under 35 U.S.C. 154(b) by 0 days.

(21) Appl. No.: 09/060,211

(22) Filed: Apr. 15, 1998

(30) Foreign Application Priority Data

Apr. 16, 1997 (IL) ..... 120685

(51) Int. Cl.[7] ..... A44C 25/00

(52) U.S. Cl. ..... 63/23; 63/1.11; 63/1.13; 63/1.16; 63/26

(58) Field of Search ..... 63/1.11, 1.13, 63/1.16, 18, 19, 21, 23, 26, 29.1

(56) References Cited

U.S. PATENT DOCUMENTS

| | | | | |
|---|---|---|---|---|
| D. 254,537 | * | 3/1980 | Abelson | D11/34 |
| D. 254,606 | * | 4/1980 | Abelson | D11/34 |
| D. 262,527 | * | 1/1982 | Goldberg | D11/2 |
| 663,866 | * | 12/1900 | Copperfield et al. | 63/18 X |
| 1,828,617 | * | 10/1931 | Peters | 63/23 |
| 1,892,738 | * | 1/1933 | Schnarr | 63/26 X |
| 2,016,679 | * | 10/1935 | Mayer | 63/15.1 |
| 2,240,247 | * | 4/1941 | Krieke | 63/26 |
| 2,566,741 | * | 9/1951 | Newhouse | 63/29.1 X |
| 2,666,306 | * | 1/1954 | Lewis | 63/26 X |
| 3,626,718 | * | 12/1971 | Schneider | 63/29.1 |
| 3,898,870 | * | 8/1975 | Jacobson | 63/23 X |
| 3,992,787 | * | 11/1976 | Lynch | 434/106 |
| 4,077,237 | * | 3/1978 | Loper | 63/31 |
| 4,353,124 | * | 10/1982 | Weinzettel et al. | 368/258 |
| 4,939,913 | * | 7/1990 | Scungio et al. | 63/21 |
| 5,632,164 | * | 5/1997 | Bergagnini | 63/23 |
| 5,753,887 | * | 5/1998 | Rosenwasser et al. | 219/121.68 |

FOREIGN PATENT DOCUMENTS

| | | | | |
|---|---|---|---|---|
| 1507595 | * | 11/1967 | (FR) | 63/23 |
| 2312987 | * | 12/1976 | (FR) | 63/23 |
| 2355474 | * | 1/1978 | (FR) | 63/23 |
| 223523 | * | 10/1924 | (GB) | 63/23 |

* cited by examiner

*Primary Examiner*—Lynne H. Browne
*Assistant Examiner*—Andrea Chop
(74) *Attorney, Agent, or Firm*—Pillsbury Madison & Sutro LLP

(57) ABSTRACT

An item of jewelry includes a first generally planar element having engraving thereon, and a second generally planar element joined to the first generally planar element and including a peripheral portion overlying a peripheral portion of the first generally planar element and having a stone setting mounted thereon and extending inwardly thereof so as to overlie part of the first generally planar element inwardly of the peripheral portion.

5 Claims, 4 Drawing Sheets

PERSONALIZED JEWELRY

FIELD OF THE INVENTION

The present invention relates to jewelry generally and more particularly to personalized jewelry.

BACKGROUND OF THE INVENTION

Various types of personalized jewelry are known. There are known engraved astrology disks which bear patterns which are determined by the precise day, hour and even minute of a person's birth.

There exists a difficulty in manufacturing jewelry which involves both soldering and engraving. Generally it is difficult, if not impossible, to solder onto an engraved member without damaging the engraving. Similarly, it is very difficult, if not impossible, to engrave a surface onto which items have been soldered.

SUMMARY OF THE INVENTION

The present invention seeks to provide an item of personalized jewelry which overcomes limitations of prior art jewelry manufacturing techniques.

There is thus provided in accordance with a preferred embodiment of the present invention an item of jewelry including a first generally planar element having personalized engraving thereon, a second generally planar element joined to the first generally planar element and including a peripheral portion overlying a peripheral portion of the first generally planar element and having a stone setting mounted thereon and extending inwardly thereof so as to overlie part of the first generally planar element inwardly of the peripheral portion.

In accordance with a preferred embodiment of the present invention, the personalized item of jewelry also includes a third generally planar element, joined to the first and second generally planar elements and including a peripheral portion which overlies the peripheral portion of the second generally planar element. Preferably the peripheral portion of the third generally planar element is also engraved.

In accordance with a preferred embodiment of the present invention, the third generally planar element comprises a plurality of pins which extend through apertures in the first and second generally planar elements for joining the first, second and third generally planar elements together.

Preferably, the ends of the pins are soldered to the back of the first generally planar element.

Additionally in accordance with a preferred embodiment of the present invention two sets of first, second and third generally planar elements are mounted in back to back arrangement.

The jewelry item of the invention may be incorporated in a pendant, a bracelet, a watch or any other suitable fashion item.

The jewelry item of the invention has the advantage that personalized jewelry may be provided to customers on a on-demand basis, while the customer waits.

The jewelry item of the present invention has the added advantage that additional stones and stone settings may be readily added to the jewelry item by simply disassembling the generally planar elements and joining an additional stone setting to the second generally planar element.

There is also provided in accordance with a preferred embodiment of the present invention a method for producing item of jewelry comprising:

engraving a personalized pattern on a first generally planar element; and joining to the first generally planar element following the engraving step, a second generally planar element including a peripheral portion overlying a peripheral portion of the first generally planar element and having a stone setting mounted thereon and extending inwardly thereof so as to overlie part of the first generally planar element inwardly of the peripheral portion.

Preferably, the method also includes joining a third generally planar element to the first and second generally planar elements, the third generally planar element including a peripheral portion which overlies the peripheral portion of the second generally planar element.

Preferably, the method additionally includes engraving the peripheral portion of the third generally planar element.

In accordance with a preferred embodiment of the present invention, the third generally planar element comprises a plurality of pins which extend through apertures in the first and second generally planar elements and joining the first, second and third generally planar elements together is effected by soldering the pins to the first generally planar element.

Additionally in accordance with a preferred embodiment of the present invention, the method also includes the step of adding a stone setting by first disassembling the generally planar elements, attaching an additional stone setting to the second generally planar element and then reassembling the generally planar elements.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
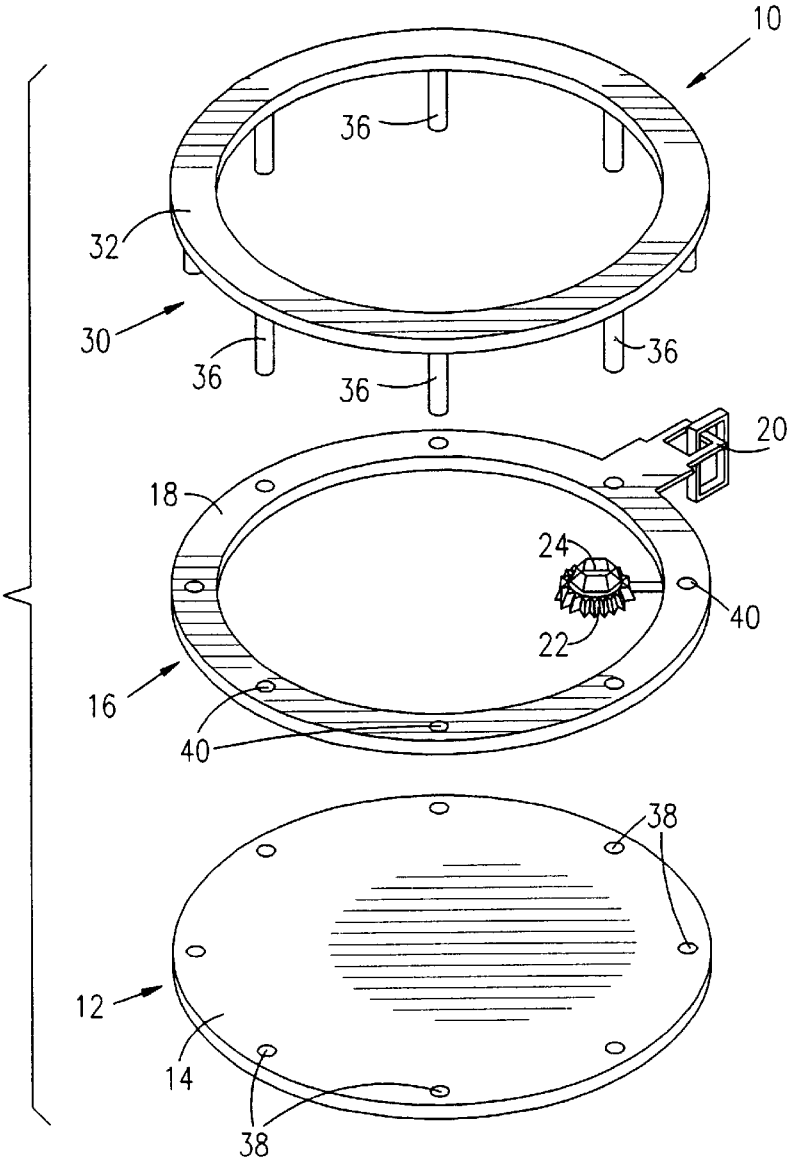
FIGS. 1A and 1B are respective exploded and assembled pictorial view illustrations of an item of jewelry constructed and operative in accordance with a preferred embodiment of the present invention.
Figure 1B:
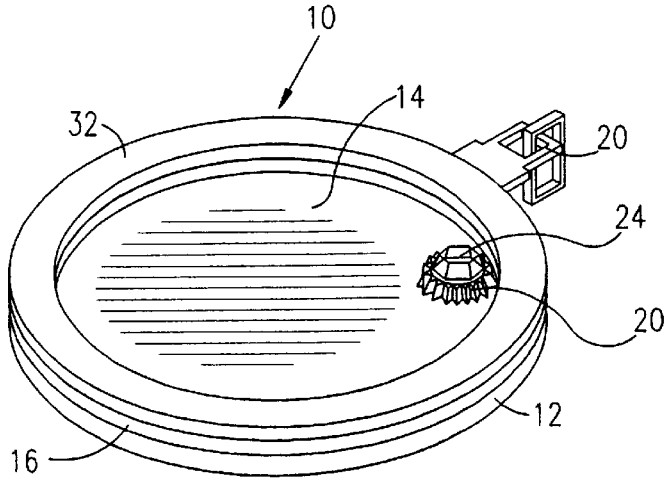
Figure 2:
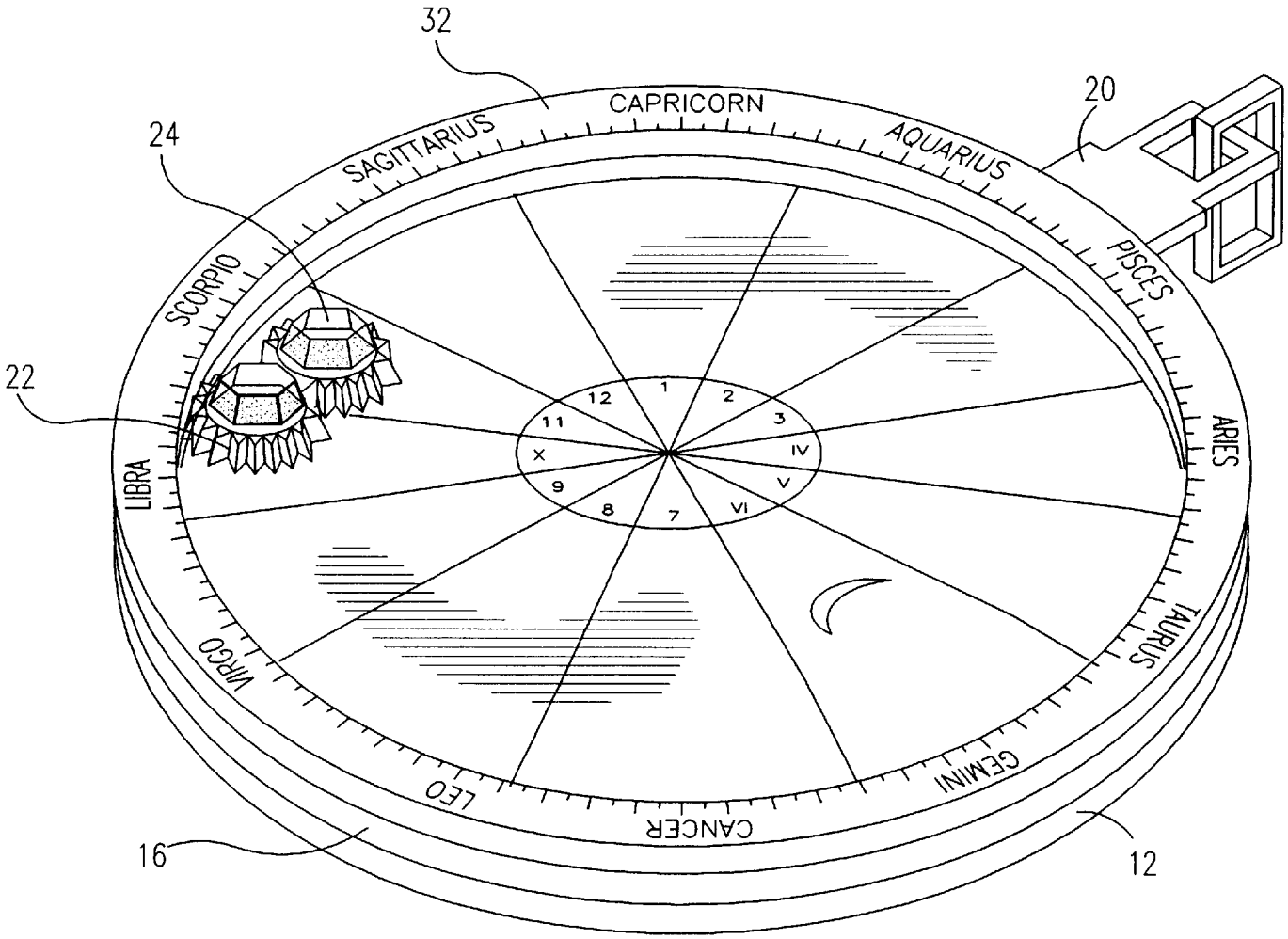
FIG. 2 is a pictorial illustration of a finished item of jewelry constructed and operative in accordance with a preferred embodiment of the invention.

Reference is now made to FIGS. 1A, 1B and 2, which are respective exploded and assembled pictorial view illustrations of an item of jewelry constructed and operative in accordance with a preferred embodiment of the present invention.

In accordance with a preferred embodiment of the present invention the item of jewelry, indicated generally by reference numeral 10, includes a first generally planar element 12, typically in the form of a disk and preferably having personalized engraving on a surface 14 thereof, typically including an astrological pattern which is particular to the time of birth of a person.

A second generally planar element 16 is joined to the first generally planar element in a manner which is described hereinbelow and preferably includes a peripheral portion 18, typically in the form of a ring, overlying a corresponding peripheral portion of the first generally planar element 12. Second generally planar element 16 is preferably formed with a chain attachment assembly 20 to enable it to be used as a pendant.

It is a particular feature of the present invention that the second generally planar element 16 is formed with a stone setting 22 mounted thereon and extending inwardly thereof so as to overlie part of the first generally planar element inwardly of the peripheral portion 18, when the first and second generally planar elements are joined. Typically, the stone setting 22 is soldered onto the second generally planar element 16 prior to assembly of the first and second generally planar elements. Any suitable precious or semi-precious stone 24 may be mounted onto stone setting 22.

In accordance with a preferred embodiment of the present invention, the personalized item of jewelry also includes a third generally planar element 30, joined to the first and second generally planar elements and including a peripheral portion 32 which overlies the peripheral portion 18 of the second generally planar element 16. Preferably the peripheral portion 32 of the third generally planar element 30 is also engraved, such as, for example, to show the various astrological signs.

In accordance with a preferred embodiment of the present invention, the third generally planar element 30 is integrally formed with a plurality of pins 36 which extend through respective apertures 38 and 40 in the first and second generally planar elements 12 and 16 for joining the first, second and third generally planar elements 12, 16 and 30 together. Preferably, the ends of the pins are soldered to the back of the first generally planar element.

The jewelry item of the invention has the advantage that personalized jewelry may be provided to customers on a on-demand basis, while the customer waits.

The jewelry item of the present invention has the added advantage that additional stones and stone settings may be readily added to the jewelry item by simply disassembling the generally planar elements and joining an additional stone setting to the second generally planar element.

Figure 3:
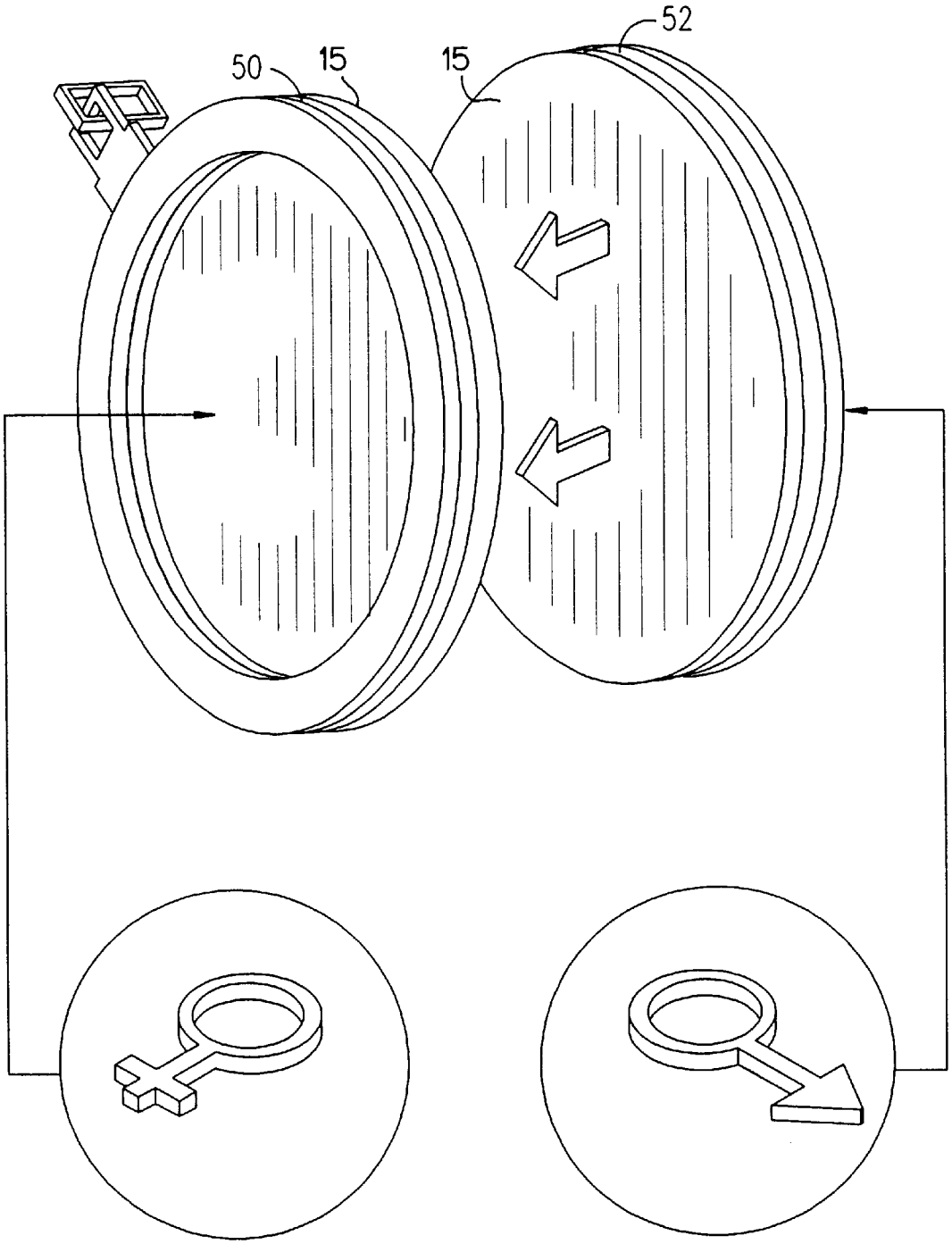
FIG. 3 is a diagrammatic illustration of a back to back, double sided jewelry item constructed and operative in accordance with a preferred embodiment of the present invention.

Reference is now made to FIG. 3, which illustrates another embodiment of the invention, wherein two sets 50 and 52, each containing first, second and third generally planar elements as described hereinabove, are mounted in back to back arrangement to form a single item of jewelry, such as a pendant, such that a back 15 of each of the first generally planar elements are joined. In this embodiment, the astrological or other personalized information of a couple, male and female, may be joined together in a single jewelry item. In a variation of this embodiment, one of the sets 50 or 52 may include less than all of the first, second and third generally planar elements. For example, a single, two-sided first generally planar element may be provided. Alternatively, only one second generally planar element, or only one third generally planar element may be employed.

Figure 4:
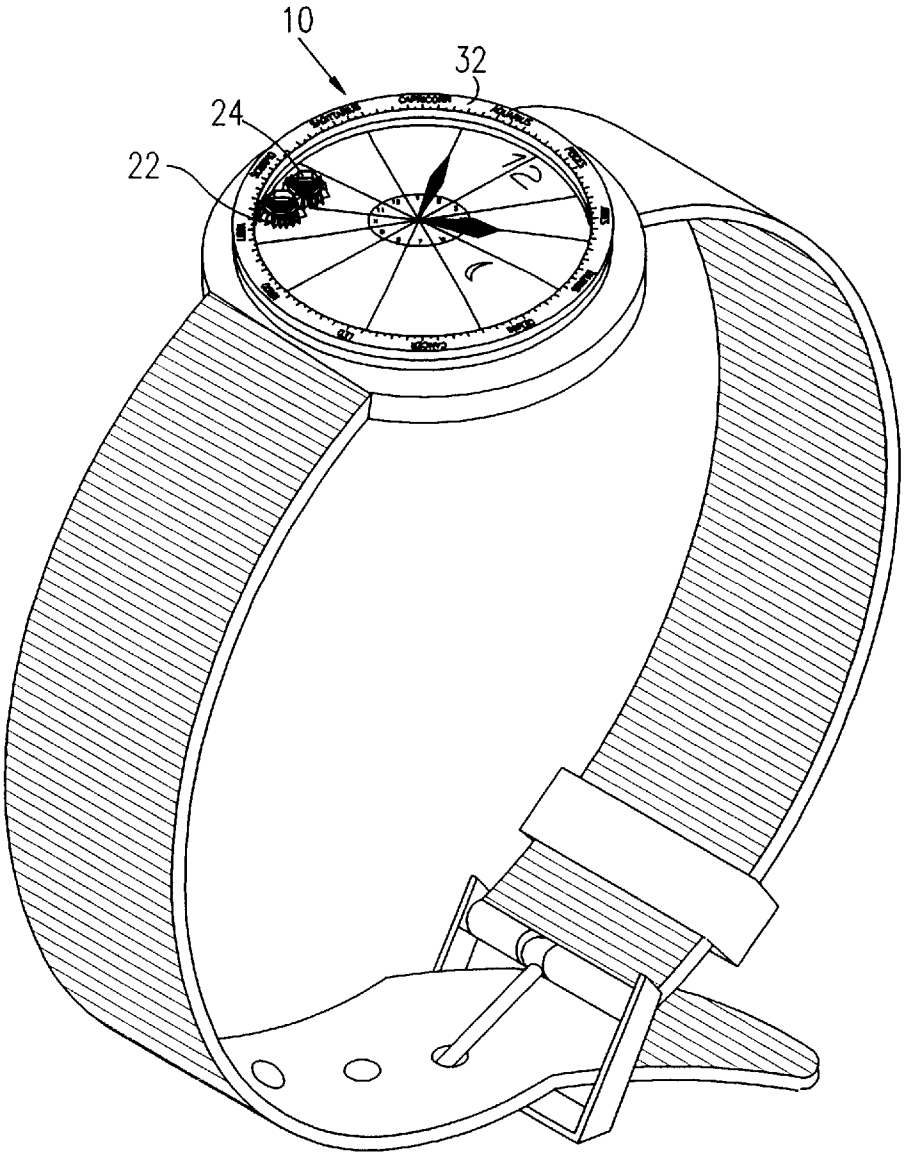
FIG. 4 is a pictorial illustration of a watch constructed and operative in accordance with a preferred embodiment of the present invention.

It is appreciated that the jewelry item of the invention may be incorporated in a pendant, a bracelet, a watch or any other suitable fashion item. FIG. 4 shows the jewelry item of the present invention incorporated into a watch.

It will be appreciated by persons skilled in the art that the present invention is not limited by what has been particularly shown and-described hereinabove. Rather the scope of the present invention is defined only by the claims which follow.

What is claimed is:

1. An item of jewelry comprising:

disk having engraving thereon;

a first ring, including a peripheral portion overlying a peripheral portion of the disk and having a stone mounted on a setting extending inwardly of the peripheral portion of said first ring so as to overlie part of the disk inwardly of the peripheral portion of the disk and a second ring, joined to the disk and to the first ring and which overlies the peripheral portion of the first ring.

2. An item of jewelry according to claim 1 and wherein the second ring is also engraved.

3. An item of jewelry according to claim 1 and wherein said second ring comprises a plurality of pins which extend through apertures formed in the disk and the first ring for joining the disk, the first ring and the second ring together.

4. An item of jewelry according to claim 3 and wherein ends of the pins are soldered to a back of the disk.

5. An item of jewelry according to claim 1 and also comprising an additional ring joined in back to back relationship with said disk and first ring.

* * * * *